US007970447B2

(12) United States Patent
Ishii et al.

(10) Patent No.: US 7,970,447 B2
(45) Date of Patent: Jun. 28, 2011

(54) HIGH FREQUENCY FILTER HAVING A SOLID CIRCULAR SHAPE RESONANCE PATTERN WITH MULTIPLE INPUT/OUTPUT PORTS AND AN INTER-PORT WAVEGUIDE CONNECTING CORRESPONDING OUTPUT AND INPUT PORTS

(75) Inventors: Masatoshi Ishii, Kawasaki (JP); Kazunori Yamanaka, Kawasaki (JP); John D. Baniecki, Kawasaki (JP); Akihiko Akasegawa, Kawasaki (JP); Teru Nakanishi, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 12/108,886

(22) Filed: Apr. 24, 2008

(65) Prior Publication Data

US 2008/0266033 A1 Oct. 30, 2008

(30) Foreign Application Priority Data

Apr. 25, 2007 (JP) ..... 2007-115538
Mar. 18, 2008 (JP) ..... 2008-069914

(51) Int. Cl.
*H01P 1/203* (2006.01)
*H01B 12/02* (2006.01)

(52) U.S. Cl. ..... 505/210; 333/99 S; 333/204; 333/205; 333/219

(58) Field of Classification Search ..... 333/204, 333/219, 99 S, 205; 505/210
See application file for complete search history.

(56) References Cited

U.S. PATENT DOCUMENTS 5,136,268 A 8/1992 Fiedziuszko et al.
5,172,084 A * 12/1992 Fiedziuszko et al. ..... 333/204
5,400,002 A * 3/1995 Takahashi et al. ..... 333/204
5,479,142 A 12/1995 Takahashi et al.
5,512,539 A * 4/1996 Matsuura et al. ..... 505/210
5,541,559 A 7/1996 Takahashi et al.
5,614,876 A 3/1997 Takahashi et al.
5,659,274 A 8/1997 Takahashi et al.

(Continued)

FOREIGN PATENT DOCUMENTS

JP 05-251904 9/1993

(Continued)

OTHER PUBLICATIONS

Japan Patent Office, Notice of Reasons of Rejection mailed in connection with JP counterpart application 2008-069914 on Mar. 8, 2011; partial English-language translation provided.

*Primary Examiner* — Benny Lee
(74) *Attorney, Agent, or Firm* — Fujitsu Patent Center

(57) ABSTRACT

A resonance pattern (21) made of conductive material and having a circular plan shape is formed over the principal surface of a dielectric substrate. First and second virtual straight lines mutually crossing at a right angle are defined. A first input port (22) and a first output port (23) are electromagnetically coupled to the resonance pattern at two cross points between the first virtual straight line and an outer circumference line of the resonance pattern. A second input port (24) and a second output port (25) are electromagnetically coupled to the resonance pattern at two cross points between the second virtual straight line and the outer circumference line of the resonance pattern. A first inter-port waveguide (26) propagates a high frequency signal output to the first output port to the second input port.

10 Claims, 13 Drawing Sheets

U.S. PATENT DOCUMENTS

| | | | | |
|---|---|---|---|---|
| 5,748,059 | A * | 5/1998 | Yabuki et al. | 333/204 |
| 6,360,112 | B1 * | 3/2002 | Mizuno et al. | 505/210 |
| 6,546,266 | B1 * | 4/2003 | Okazaki et al. | 505/210 |
| 6,980,841 | B2 * | 12/2005 | Kai et al. | 505/210 |
| 2007/0229183 | A1 | 10/2007 | Akasegawa et al. | |
| 2009/0239752 | A1 | 9/2009 | Akasegawa et al. | |

FOREIGN PATENT DOCUMENTS

| | | | |
|---|---|---|---|
| JP | 6-37504 | A | 2/1994 |
| JP | H07-307613 | | 11/1995 |
| JP | 10-173405 | A | 6/1998 |
| JP | 2006-101187 | A | 4/2006 |
| JP | 2006-115416 | A | 4/2006 |

* cited by examiner

HIGH FREQUENCY FILTER HAVING A SOLID CIRCULAR SHAPE RESONANCE PATTERN WITH MULTIPLE INPUT/OUTPUT PORTS AND AN INTER-PORT WAVEGUIDE CONNECTING CORRESPONDING OUTPUT AND INPUT PORTS

CROSS REFERENCE TO RELATED APPLICATION

This application is based on and claims priority of Japanese Patent Application Nos. 2007-115538 filed on Apr. 25, 2007 and 2008-069914 filed on Mar. 18, 2008, the entire contents of which are incorporated herein by reference.

BACKGROUND OF THE INVENTION

A) Field of the Invention

The present invention relates to a high frequency filter having a resonance pattern of a microstrip line or a strip line structure.

B) Description of the Related Art

FIG. 13A is a plan view of a conventional high frequency filter, and FIG. 13B is a cross sectional view taken along one-dot chain line 13B-13B in FIG. 13A (JP-A-2006-115416).

On a principal surface of a dielectric substrate 101 (FIG. 13B), a resonance pattern 102, an input port 103 and an output port 104 (FIG. 13A) are formed. The resonance pattern 102 has a circular plan shape as illustrated in FIG. 13A. The input port 103 and output port 104 are electromagnetically coupled to the resonance pattern 102 at two points on a circumference of the resonance pattern 102 and on two radii intersecting with each other at a right-angle as illustrated in FIG. 13A. On the bottom surface of the dielectric substrate 101, a ground film 105 is formed as illustrated in FIG. 13B. The resonance pattern 102, ground film 105 and dielectric substrate 101 constitute a microstrip line.

Another dielectric substrate 110 is placed on the resonance pattern 102 as illustrated in FIG. 13B. On the surface of the dielectric substrate 110, a conductive pattern 111 is formed. The conductive pattern 111 is disposed at a position superposing upon a center point of an arc having a center angle of 270°, one end of the arc being a coupling position between the input port 103 and resonance pattern 102 and the other end of the arc being a coupling position between the output port 104 and resonance pattern 102. Plan shape of the conductive pattern 111 is, for example, a circular shape, and a diameter of the conductive pattern 111 is equal to or shorter than quarter of an effective wavelength of a high frequency signal propagating along the microstrip line.

Degeneration of two electromagnetic field modes of the resonance pattern 102 mutually crossing at a right angle is resolved and the resonance frequency is separated because the conductive pattern 111 and resonance pattern 102 are electromagnetically coupled with each other. In this state, the high frequency device shown in FIG. 13A functions as a dual mode filter.

As compared with a hair pin type resonance pattern and a straight line type resonance pattern, in the disc type resonance pattern shown in FIGS. 13A and 13B, current concentration upon a specific area is hard to occur. As compared also with a disc pattern having a notch at a disc circumference, current concentration upon a specific area is inhibited. Power tolerance of the disc type resonance pattern shown in FIGS. 13A and 13B is therefore high. The disc type resonance pattern shown in FIGS. 13A and 13B is expected to be applied to a transmission filter.

The characteristics of the high frequency filter shown in FIGS. 13A and 13B deviate from design values because of an air gap generated between the resonance pattern 102 and overlying dielectric substrate 110, a position displacement between the resonance pattern 102 and conductive pattern 111, and the like.

SUMMARY OF THE INVENTION

One possible object is to provide a high frequency filter capable of inhibiting current concentration upon a specific area of a resonance pattern and deviation of the filter characteristics from design values.

The present invention is directed to an embodiment of a high frequency filter including:

a substrate made of dielectric material;

a first resonance pattern made of conductive material, formed over a principal surface of the substrate and having a circular plan shape;

a first input port electromagnetically coupled with the first resonance pattern at one cross point between a first virtual straight line passing through a center of the first resonance pattern and an outer circumference line of the first resonance pattern;

a first output port electromagnetically coupled with the first resonance pattern at the other cross point between the first virtual straight line and the outer circumference line of the first resonance pattern;

a second input port electromagnetically coupled with the first resonance pattern at one cross point between a second virtual straight line and the outer circumference line of the first resonance pattern, the second virtual straight line passing through the center of the first resonance pattern and crossing the first virtual straight line at a right angle;

a second output port electromagnetically coupled with the first resonance pattern at the other cross point between the second virtual straight line and the outer circumference line of the first resonance pattern; and a first inter-port waveguide for propagating a high frequency signal from the first output port to the second input port.

DESCRIPTION OF THE PREFERRED EMBODIMENTS

It must be noted that like features depicted in the different drawing or figures are designated by the same reference numbers and may not be described in detail for all drawing or figures in which they appear.

Figure 1A:
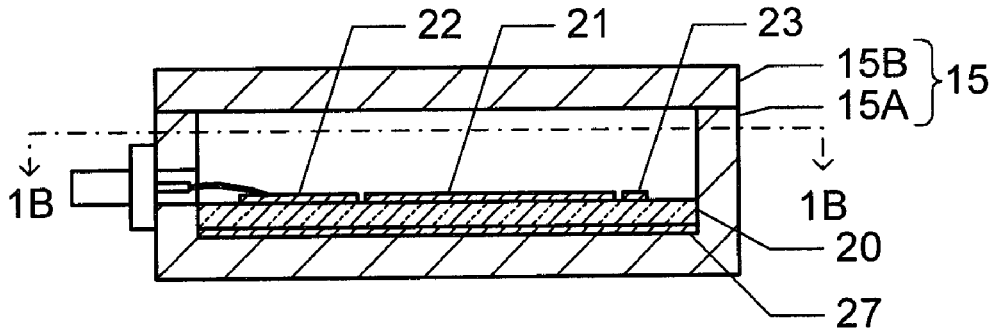
FIG. 1A is a cross sectional view of a high frequency filter according to a first embodiment.
Figure 1B:
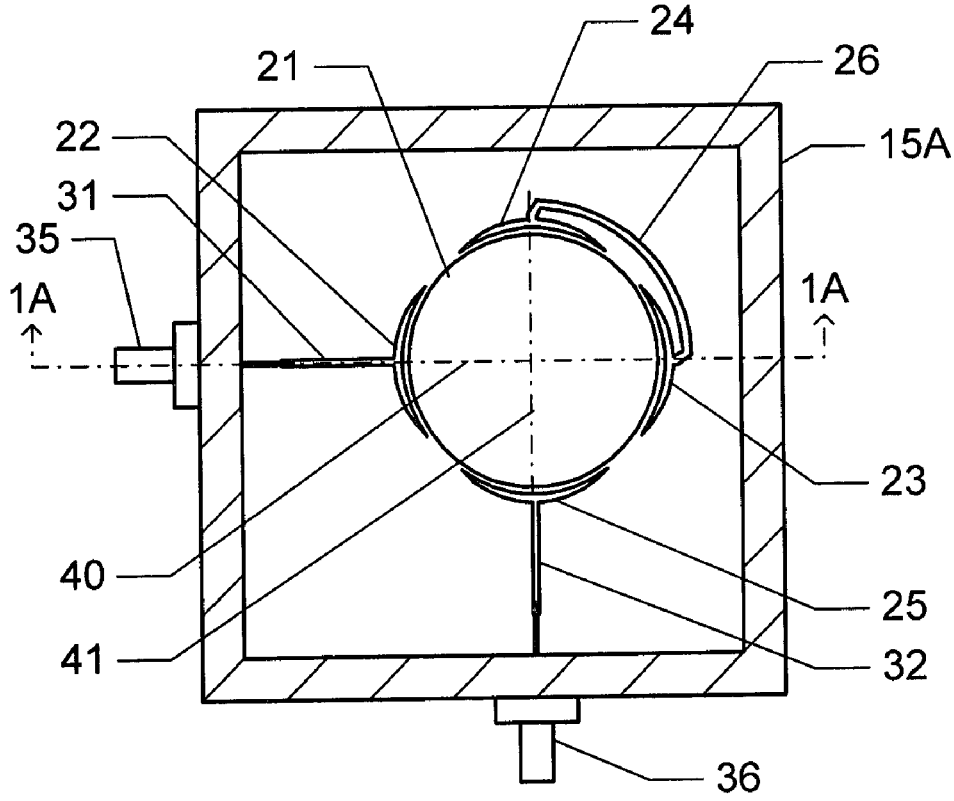
FIG. 1B is a plan cross sectional view of the filter.

FIG. 1A is a cross sectional view of a high frequency filter according to the first embodiment, and FIG. 1B is a plan cross sectional view taken along one-dot chain line 1B-1B in FIG. 1A. A cross sectional view taken along one-dot chain line 1A-1A in FIG. 1B corresponds to FIG. 1A.

A dielectric substrate 20 (FIG. 1A) is disposed on the inner bottom surface of a main body 15A of a package 15 (FIG. 1A), a resonance pattern 21 and the like being formed on a principal surface of the dielectric substrate 20 and a ground film 27 (FIG. 1A) being formed on a bottom surface of the dielectric substrate 20. The ground film 27 is in contact with the inner bottom surface of the package main body 15A.

The package main body 15A is a container of a rectangular parallelepiped shape with an upper opening, and this opening is closed with a ceiling plate 15B as illustrated in FIG. 1A. The package main body 15A and ceiling plate 15B constitute the package 15 defining an inner closed space. The package 15 is made of, e.g., oxygen free cupper excellent in thermal conductivity and electrical conductivity. Instead of oxygen free copper, the package 15 may be made of pure aluminum, aluminum alloy, cupper alloy or the like. The package 15 may further be made of KOVAR (Fe54%-Ni29%-Co17% alloy), INVAR (Fe63.8%-Ni36%C0.2% alloy), 42-Alloy (Fe58%-Ni42% alloy) or the like which have a thermal shrinkage factor near that of the dielectric substrate 20. The package 15 is plated with gold to a thickness of about 2 μm in order to prevent deterioration of electrical characteristics otherwise to be caused by surface oxidation.

The dielectric substrate 20 is made of magnesium oxide (MgO) exposing a (100) crystal plane on its principal surface, and has a thickness of 0.5 mm. Material of the dielectric substrate 20 may be dielectric material having a high dielectric constant and a low loss such as $LaAlO_3$ and sapphire.

As shown in FIG. 1B, formed on the principal surface of the dielectric substrate 20 are a resonance pattern 21, a first input port 22, a first output port 23, a second input port 24, a second output port 25 and an inter-port waveguide 26. If a band-pass filter of a 5 GHz band is to be fabricated on the dielectric substrate 20, the resonance pattern 21 has a circular plan shape (disk shape) of 11 mm in diameter. In this case, the following formula stands:

$$d=(n/2)\lambda_r \text{ (}n\text{ is a natural number)} \quad (1)$$

where $\lambda_r$ is a wavelength of a high frequency signal resonating in the resonance pattern 21 and d is a diameter of the resonance pattern 21. A frequency corresponding to a wavelength $\lambda_r$ at n=1 is called a "fundamental resonance frequency". Namely, a signal at the fundamental resonance frequency of the resonance pattern 21 has a wavelength of twice as long as the diameter, i.e., 22 mm. An actual resonance frequency can be obtained from an effective dielectric constant of the microstrip line and a resonance frequency measured electrically. Practically, the wavelength of a resonating high frequency signal shifts slightly from the resonance wavelength $\lambda_r$ calculated by the formula (1) because of leakage radiation of an electromagnetic wave from an edge of the resonance pattern 21.

A first virtual straight line 40 and a second virtual straight line 41 are defined which are crossing at a right angle and pass through the center of the resonance pattern 21. At one cross point between the circumference of the resonance pattern 21 and the first virtual straight line 40, the first input port 22 is electromagnetically coupled with the resonance pattern 21, and at the other cross point, the first output port 23 is electromagnetically coupled with the resonance pattern 21. A plan shape of each of the first input port 22 and first output port 23 is a crescent shape having a radius of curvature in conformity with the circumference of the resonance pattern 21, and is line-symmetric with respect to the first virtual straight line 40.

At one cross point between the circumference of the resonance pattern 21 and the second virtual straight line 41, the second input port 24 is electromagnetically coupled with the resonance pattern 21, and at the other cross point, the second output port 25 is electromagnetically coupled with the resonance pattern 21. A plan shape of each of the second input port 24 and second output port 25 is a falcate shape having a radius of curvature in conformity with the circumference of the resonance pattern 21, and is line-symmetric with respect to the second virtual straight line 41. Each of these input and output ports 22 to 25 is disposed spaced by a gap of 25 to 100 μm from the edge of the resonance pattern 21.

An input waveguide 31 is connected to the first input port 22. The input waveguide 31 is disposed along the first virtual straight line 40. An output waveguide 32 is connected to the second output port 25. The output waveguide 32 is disposed along the second virtual straight line 41. The inter-port waveguide 26 connects the first output port 23 to the second input port 24 and transmits a high frequency signal from the first output port 23 to the second input port 24.

The resonance pattern 21, input and output ports 22 to 25, waveguides 31 and 32, inter-port waveguide 26 and ground film 27 are made of $YBa_2Cu_3O_{6+x}$ (hereinafter called "YBCO"), and have a thickness of 100 to 500 nm. Instead of YBCO, these conductive patterns may be made of superconductive oxide material presenting a superconductivity state at a liquid nitrogen temperature. Examples of the superconductive oxide material include R—Ba—Cu—O based material (R is Nb, Ym, Sm or Ho), Bi—Sr—Ca—Cu—O based material, Pb—Bi—Sr—Ca—Cu—O based material, $CuBa_pCa_qCu_rO_x$ based material ($1.5<p<2.5$, $2.5<q<3.5$, $3.5<r<4.5$) and the like.

A width of each of the input waveguide 31, output waveguide 32 and inter-port waveguide 26 is 0.5 mm when these waveguides are formed on the dielectric substrate 20, and the characteristic impedance of each waveguide is 50Ω. An electrode is formed on the surface of each of the input waveguide 31 and output waveguide 32 near the end thereof farther away from the resonance pattern 21, the electrode being a lamination of a Cr film, a Pd film and an Au film stacked in this order.

The YBCO film can be formed, for example, by pulse laser vapor deposition. Each YBCO pattern on the principal surface of the dielectric substrate 20 can be formed by using typical photolithography techniques. The electrode including the Cr film, Pd film and Au film can be formed by vapor deposition and lift-off.

A coaxial input connector 35 and a coaxial output connector 36 are mounted on side walls of the package main body 15A. A central conductor of the input connector 35 is connected to the electrode at the end of the input waveguide 31 by an Au wire having a diameter of 25 μm, and a central conductor of the output connector 36 is connected to the electrode at the end of the output waveguide 32 by an Au wire having a diameter of 25 μm. Instead of the Au wire, an Au ribbon or an Al wire may be used.

Figure 2A:
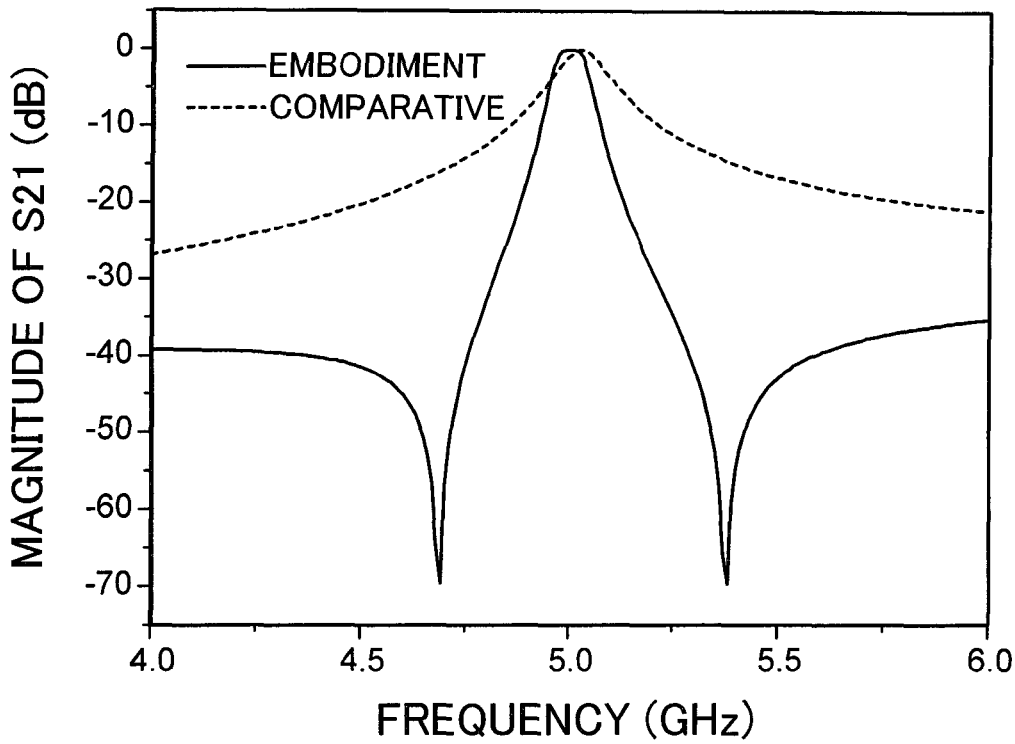
FIG. 2A is a graph showing simulation results of transmission characteristics of high frequency filters of the first embodiment and a comparative example.
Figure 2B:
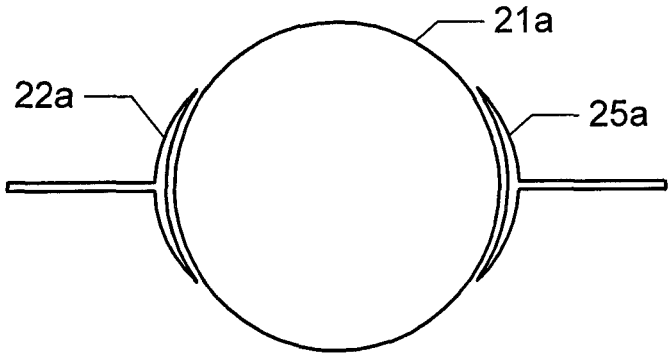
FIG. 2B is a plan view of a conductive pattern of the high frequency filter of the comparative example.

FIG. 2A shows simulation results of the transmission characteristics (frequency dependency of an S parameter S21) of a high frequency filter of the first embodiment, which is indicated by a solid line. An electromagnetic field simulator manufactured by Sonnet Software Inc. was used for simulation. The abscissa represents a frequency in the unit of "GHz", and the ordinate represents a magnitude of S21 in the unit of "dB". For comparison, the transmission characteristics of a high frequency filter (comparative example) having a resonance pattern shown in FIG. 2B is indicated by a broken line. In the high frequency filter of the comparative example as illustrated in FIG. 2B, an input port 22*a* and an output port 25*a* are disposed at positions facing each other via the circular resonance pattern 21*a*.

Referring to FIG. 2A, S21 of the high frequency filter of the first embodiment has a maximum value at a frequency of about 5 GHz. By adopting the structure of the embodiment, sharper frequency cutoff characteristics are obtained more than the high frequency filter of the comparative example shown in FIG. 2B. Particularly in the first embodiment, attenuation poles appear in frequency bands outside the cutoff frequency and it can be understood that sharp frequency cutoff characteristics are obtained.

Figure 3:
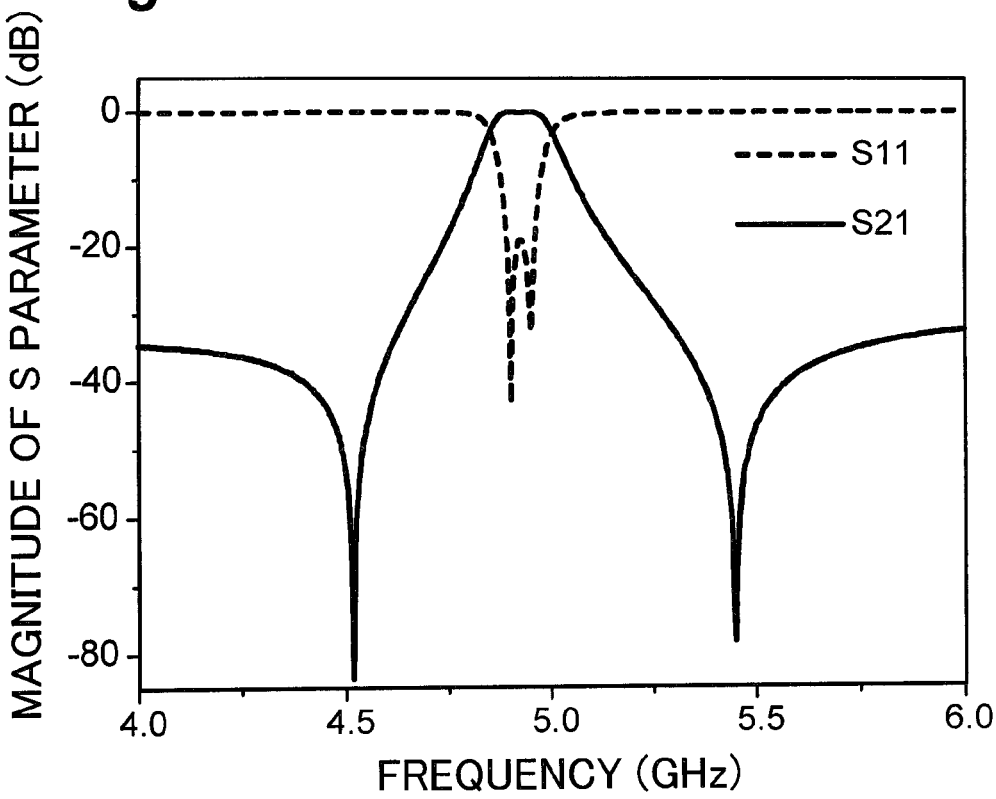
FIG. 3 is a graph showing measurement results of transmission characteristics and reflection characteristics of the high frequency filter of the first embodiment.

FIG. 3 shows actually measured S parameters of the high frequency filter of the first embodiment. An MgO substrate of 0.5 mm thick exposing a (100) crystal plane was used as the dielectric substrate 20, and each pattern on the principal surface of the dielectric substrate 20 and the ground film 27 were made of YBCO and had a thickness of 500 nm. A diameter of the resonance pattern 21 was set to 11 mm, and a gap between the edge of the resonance pattern 21 and each of the input ports 22 to 25 was set to 25 μm. A length of the inter-port waveguide 26 was set to 12.1 mm. This length means a length of a route from the border of the first input port 23 facing the resonance pattern 21, via the center of the inter-port waveguide 26, to the border of the second input port 24 facing the resonance pattern 21. The S parameters of the high frequency filter were measured in a superconductivity state of the YBCO films cooled to a temperature of 65 K.

The abscissa of FIG. 3 represents a frequency in the unit of "GHz", and the ordinate represents a magnitude of S parameters in the unit of "dB". A solid line in the graph indicates S21, i.e., transmission characteristics, and a broken line indicates S11, i.e., reflection characteristics. It can be understood that the high frequency filter has sharp frequency cutoff characteristics like the simulation results shown in FIG. 2A.

Figure 13A:
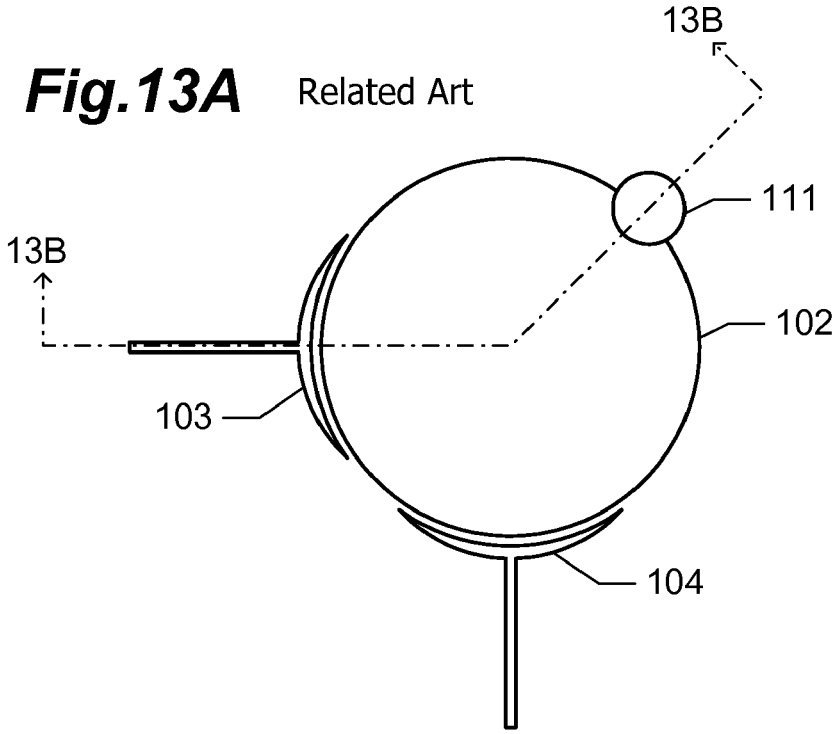
Fig.13A Related Art
FIG. 13A is a plan view of a conductive pattern of a conventional high frequency filter.
Figure 13B:
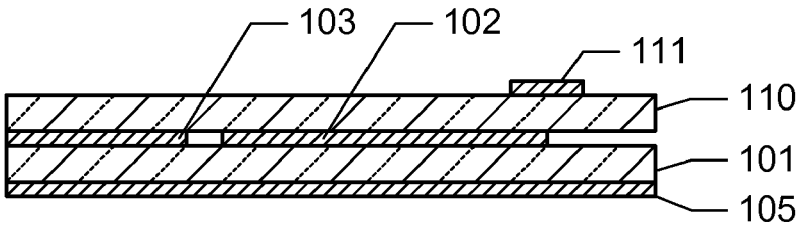
Fig.13B Related Art
FIG. 13B is a cross sectional view showing the main portion of the conventional high frequency filter.

As different from the conventional high frequency filter shown in FIGS. 13A and 13B, the first embodiment does not require a plurality of dielectric substrates. The frequency characteristics will not deviate from the design values, otherwise to be caused by a position displacement among a plurality of dielectric substrates.

Figure 4:
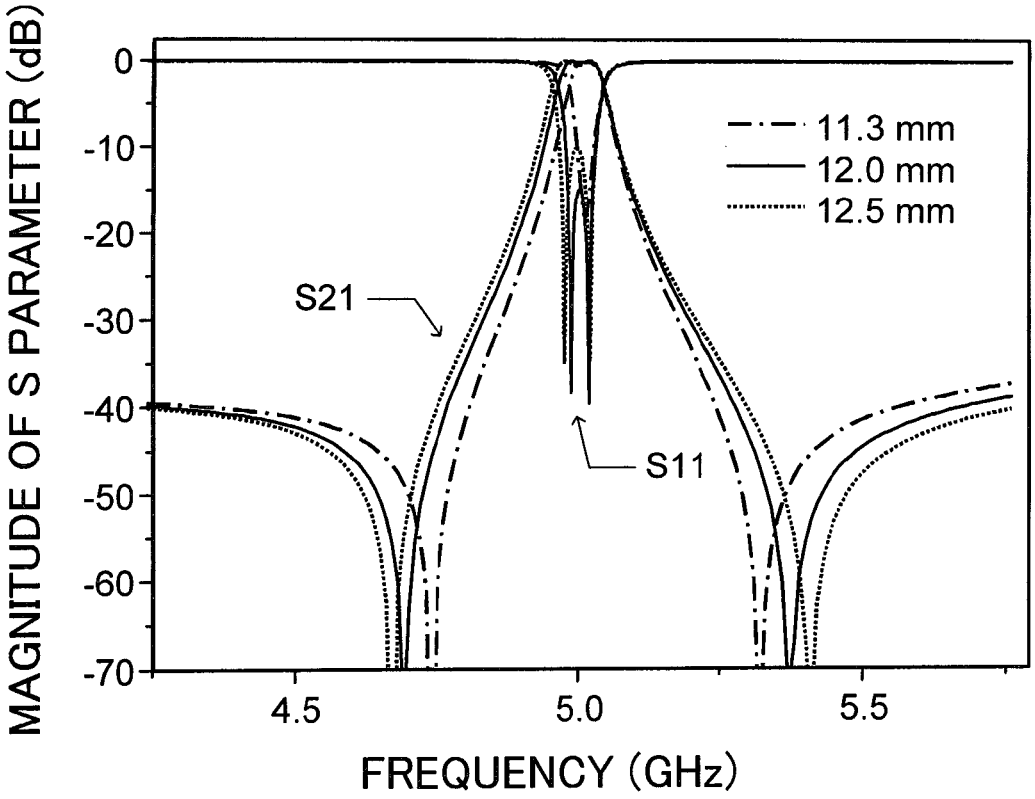
FIG. 4 is a graph showing simulation results of transmission characteristics and reflection characteristics of a plurality of samples obtained by changing an electrical line length of an intermediate waveguide between ports of the high frequency filter of the first embodiment.

FIG. 4 shows simulation results of S parameters of three types of high frequency filters having different lengths of the inter-port waveguides 26, with a gap between each of the input ports 22 to 25 and the edge of the resonance pattern 21 being set to 75 μm. The abscissa represents a frequency in the unit of "GHz", and the ordinate represents a magnitude of S parameters in the unit of "dB". A one-dot chain line, a solid line and a broken line indicate S parameters of the high frequency filters, with the lengths of the inter-port waveguides 26 being set to 11.3 mm, 12.0 mm and 12.5 mm, respectively. S11 and S21 are shown in FIG. 4.

A waveguide having a width of 0.5 mm formed on an MgO substrate having a thickness of 0.5 mm has an effective dielectric constant of 6.50. Therefore, a wavelength of a high frequency signal at 5 GHz propagating along the waveguide is 23.5 mm. Transmission line lengths of the inter-port waveguides 26 having lengths of 11.3 mm, 12.0 mm and 12.5 mm are therefore 0.48 times, 0.51 times and 0.53 times the transmission line wavelength of a high frequency signal, respectively. A transmission line length of a waveguide normalized by a transmission line wavelength of a signal having a specific frequency and propagating along the waveguide is called an "electrical transmission line length".

Every high frequency filter takes a maximum value of S21 near at a frequency of 5 GHz, and has an attenuation pole on both sides of this frequency. S11 parameter shows two sharp minimum values near at a frequency of 5 GHz. This indicates that a dual mode resonance occurs in the resonance pattern 21. An interval between these two minimum values broadens as the electrical transmission line length of the inter-port waveguide 26 is made longer. The passband width of S21 broadens as the electrical transmission line length of the inter-port waveguide 26 elongates. This means that as the electrical transmission line length of the inter-port waveguide 26 is made longer, coupling of the dual mode increases.

A change in the pass band with the electrical transmission line length of the inter-port waveguide 26 can be explained by an inter-resonance coupling coefficient k. The inter-resonance coupling coefficient k is given by the following formula:

$$k=(fh^2-fl^2)/(fh^2+fl^2) \quad (2)$$

where fl and fh (fl<fh) represent two different resonance frequencies while dual mode resonances occur.

Figure 5:
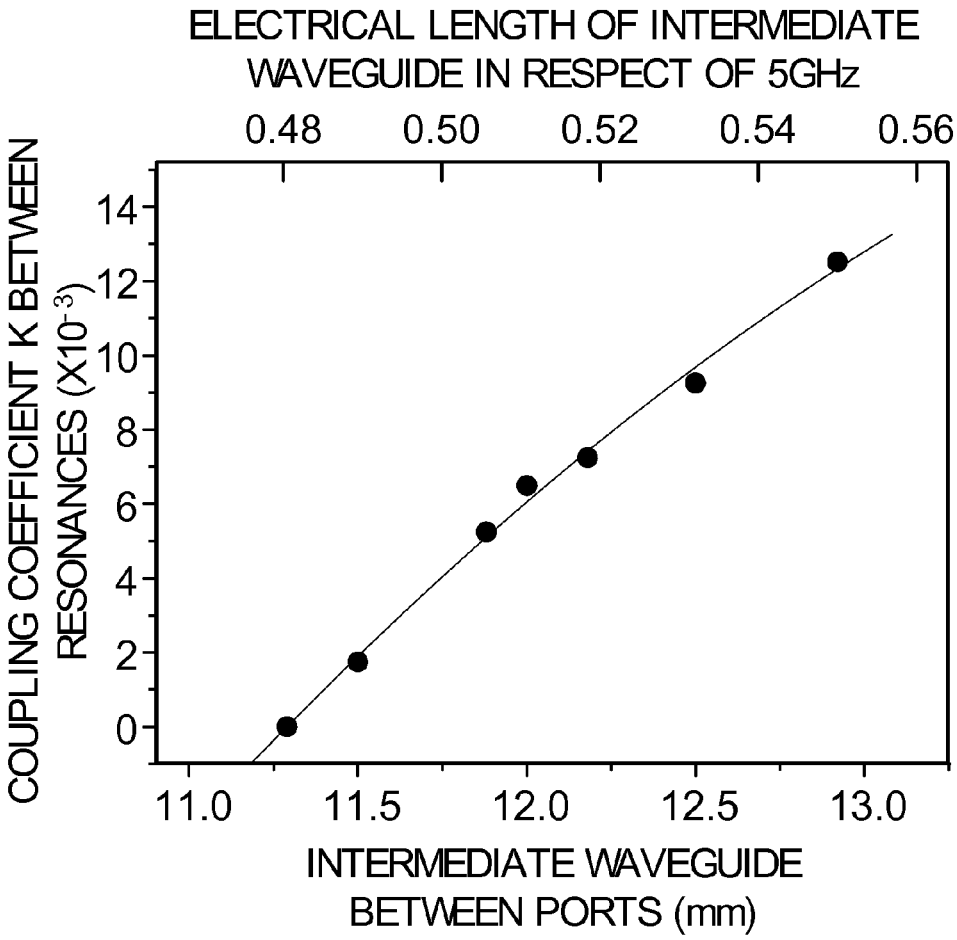
FIG. 5 is a graph showing the relation between a length of an intermediate waveguide between ports and a coupling coefficient between resonances.

FIG. 5 shows a change in the inter-resonance coupling coefficient k when a length of the inter-port waveguide 26 is changed. The lower abscissa of FIG. 5 represents a length of the inter-port waveguide 26 in the unit of "mm", and the ordinate represents the inter-resonance coupling coefficient k. The upper abscissa of FIG. 5 represents the electrical transmission line length of the inter-port waveguide 26 normalized by a transmission line wavelength of 23.5 mm of a high frequency signal at 5 GHz.

The inter-resonance coupling coefficient k becomes 0 as a transmission line length of the inter-port waveguide 26 is set to 11.3 mm (the electrical transmission line length normalized by the transmission line wavelength of a high frequency signal at a frequency of 5 GHz is about 0.48), and the passband width becomes narrowest. As the inter-port waveguide 26 is elongated, the inter-resonance coupling coefficient k increases. It can be understood from the graph shown in FIG. 5 that the passband width can be adjusted by changing the transmission line length of the inter-port waveguide 26 in a range equal to or shorter than 56% of the transmission line wavelength of a high frequency signal at 5 GHz. A lower limit of the range of the transmission line length in which the passband width can be adjusted is properly set to a length at which the inter-resonance coupling coefficient k becomes 0.

The electrical transmission line length of the inter-port waveguide 26 depends on its geometrical length and width, a gap between the first output port 23 and resonance pattern 21, a gap between the second input port 24 and resonance pattern 21, a dielectric constant of ambient space of the inter-port waveguide 26, and the like. By changing these parameters, the electrical line length of the inter-port waveguide 26 can therefore be changed.

Figure 6A:
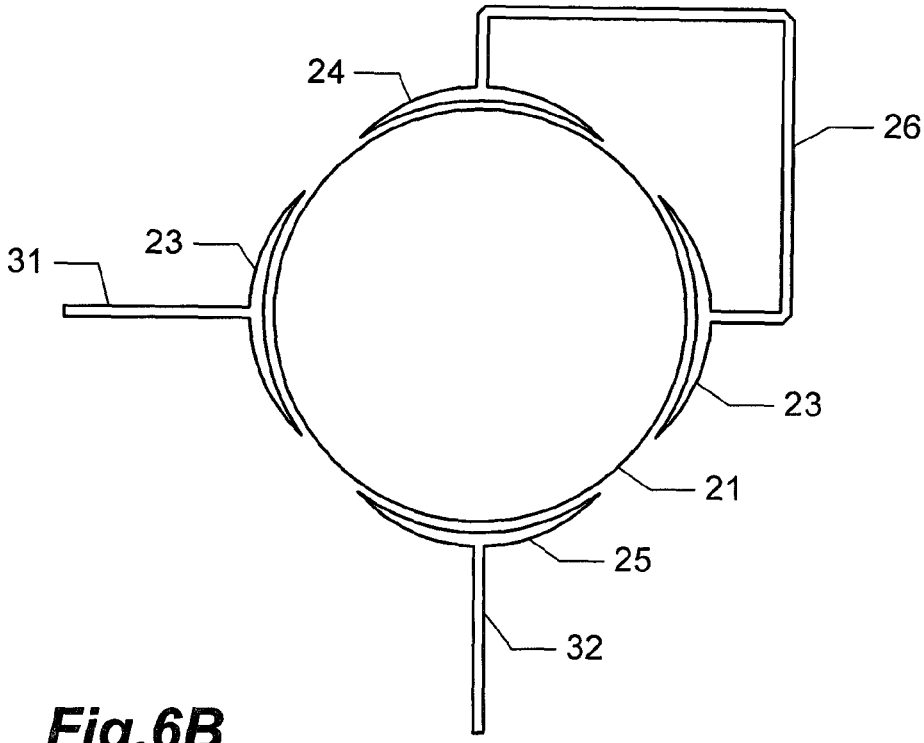
FIG. 6A is a plan view of a conductive pattern when an electrical line length of an intermediate waveguide between ports of the high frequency filter of the first embodiment is set approximately to a fundamental resonance wavelength.

FIG. 6A shows patterns formed on the principal surface of the dielectric substrate 20 (FIG. 1A) when the electrical transmission line length of the inter-port waveguide 26 is set generally equal to a transmission line wavelength corresponding to the fundamental resonance frequency.

Figure 6B:
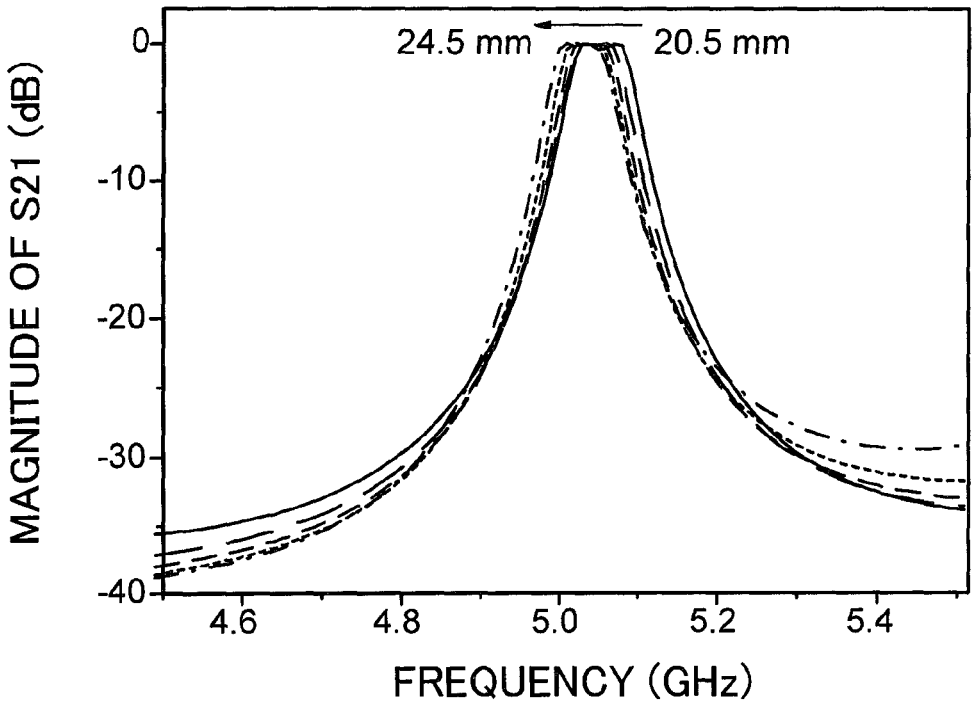
FIG. 6B is a graph showing simulation results of transmission characteristics of a plurality of samples obtained by changing an electrical line length of an intermediate waveguide between ports.

FIG. 6B shows simulation results of the transmission characteristics (frequency dependency of S21) of high frequency filters when the electrical transmission line length of the inter-port waveguide 26 in FIG. 6A is changed in a range from 20.5 mm to 24.5 mm. The abscissa represents a frequency in the unit of "GHz", and the ordinate represents a magnitude of S21 in the unit of "dB". S21 takes a maximum value near at a frequency of 5 GHz, and it can be confirmed that resonances of a dual mode occur. However, as different from the case shown in FIG. 4, attenuation poles do not appear on both sides of the frequency at which the maximum value appears.

In the range between 20.5 mm and 24.5 mm of the transmission line length of the inter-port waveguide 26, as the transmission line length becomes longer, the transmission band shifts toward the low frequency side. The transmission characteristics show a similar tendency if the transmission line length of the inter-port waveguide 26 is in the range between 0.9 times and 1.1 times the transmission line wavelength corresponding to the fundamental resonance frequency. It is therefore possible to shift the transmission band, by changing the transmission line length of the inter-port waveguide 26 in the range between 0.9 times and 1.1 times the transmission line wavelength corresponding to the fundamental resonance frequency.

Figure 7A:
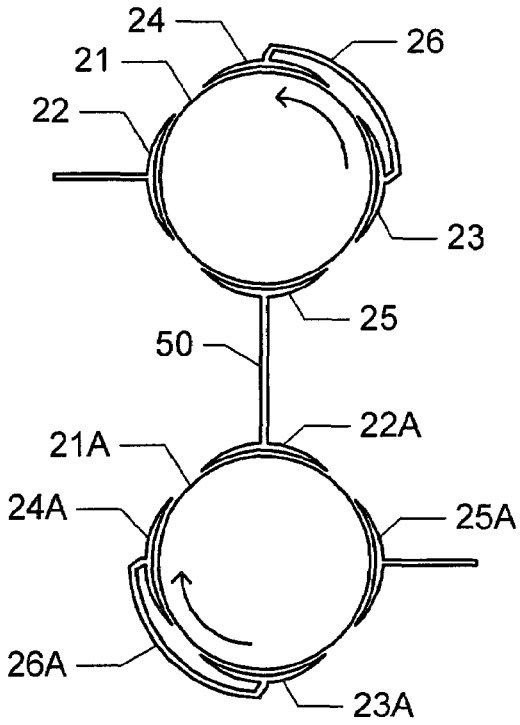
FIG. 7A is a plan view of a conductive pattern of a high frequency filter according to a second embodiment.

FIG. 7A shows a conductive pattern formed on a dielectric substrate of a high frequency filter according to the second embodiment. The high frequency filter of the first embodiment has a one-stage structure using one resonance pattern 21, whereas the high frequency filter of the second embodiment has a two-stage structure. The first stage conductive pattern is the same as the conductive pattern of the high frequency filter of the first embodiment shown in FIGS. 1A and 1B. The second stage conductive pattern is equal to a conductive pattern obtained by rotating a mirror image of the first stage conductive pattern. A resonance pattern 21A, a third input port 22A, a third output port 23A, a fourth input port 24A, a fourth output port 25A and an inter-port waveguide 26A of the second stage conductive pattern respectively correspond to the resonance pattern 21, first input port 22, first output port 23, second input port 24, second output port 25 and inter-port waveguide 26 of the conductive pattern of the first embodiment.

As described above, the second stage conductive pattern is equal to a mirror image of the first stage conductive pattern. Therefore, as viewed toward the principal surface of the dielectric substrate 20 (FIG. 1A), a direction (counterclockwise direction in FIG. 7A) of rotation from the first output port 23 toward the second input port 24 around the center of the first stage conductive pattern 21, is opposite to a direction (clockwise direction in FIG. 7A) of rotation from the third output port 23A toward the fourth input port 24A around the center of the second stage conductive pattern 21A.

An inter-stage waveguide 50 interconnects the second output port 25 of the first stage and the third input port 22A of the second stage. A transmission line length of the inter-stage waveguide 50 is ⅜ times the transmission line wavelength corresponding to the fundamental resonance.

Figure 7B:
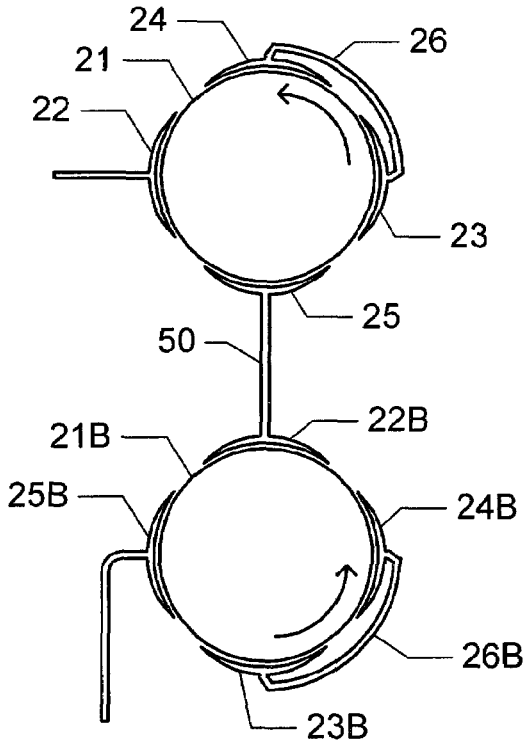
FIG. 7B is a plan view of a conductive pattern of a high frequency filter of a comparative example.

FIG. 7B shows a conductive pattern formed on the dielectric substrate of a high frequency filter according to a comparative example. In the second embodiment the conductive pattern of the second stage is coincident with a conductive pattern obtained by rotating a mirror image of the first conductive pattern of the first embodiment, whereas in the comparative example, the conductive pattern of the second stage is coincident with a conductive pattern obtained by rotating the conductive pattern of the first stage itself. A resonance pattern 21B, a third input port 22B, a third output port 23B, a fourth input port 24B, a fourth output port 25B and an inter-port waveguide 26B of the second stage conductive pattern respectively correspond to the resonance pattern 21, first input port 22, first output port 23, second input port 24, second output port 25 and inter-port waveguide 26 of the conductive pattern of the first embodiment.

The second stage conductive pattern is coincident with a conductive pattern obtained by rotating the first stage conductive pattern itself. Therefore, as viewed toward the principal surface of the dielectric substrate 20, a direction (clockwise direction in FIG. 7B) of rotation from the first output port 23 toward the second input port 24 around the center of the first stage conductive pattern 21, is the same as a direction (clockwise direction in FIG. 7B) of rotation from the third output port 23B toward the fourth input port 24B around the center of the second stage conductive pattern 21B.

An inter-stage waveguide 50 interconnects the second output port 25 of the first stage and the third input port 22B of the second stage. A transmission line length of the inter-stage waveguide 50 is ⅜ times the transmission line wavelength corresponding to the fundamental resonance.

Figure 8:
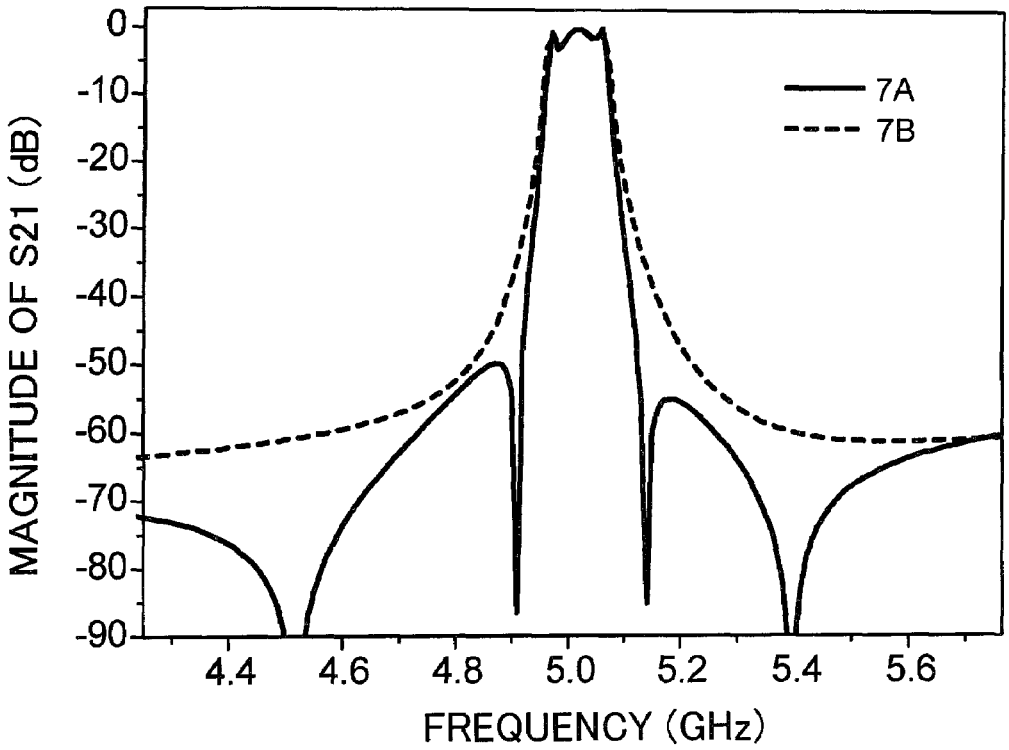
FIG. 8 is a graph showing simulation results of transmission characteristics of high frequency filters of the second embodiment and a comparative example.

FIG. 8 shows simulation results of the transmission characteristics (frequency dependency of S21) of high frequency filters of the second embodiment and comparative example. The abscissa represents a frequency in the unit of "GHz", and the ordinate represents a magnitude of S21 in the unit of "dB". A solid line in FIG. 8 indicates S21 of the high frequency filter of the second embodiment shown in FIG. 7A, and a broken line indicates a magnitude of S21 of the high frequency filter of the comparative example shown in FIG. 7B. Both the high frequency filters show the band pass filter characteristics having a passband whose center is a frequency of about 5 GHz.

In the second embodiment, two attenuation poles appear on both sides of the passband. In contract, in the comparative example, no attenuation pole appears. As in the second embodiment, by giving a mirror image relation between the first stage conductive pattern and second stage conductive pattern, the cutoff frequency characteristics can be made sharper. It can be considered that different behaviors of the transmission characteristics between the high frequency filter of the second embodiment and the high frequency filter of the comparative example may be ascribed to that electromagnetic waves radiated upward from the resonance patterns of the first and second stages are mutually influenced.

Figure 9:
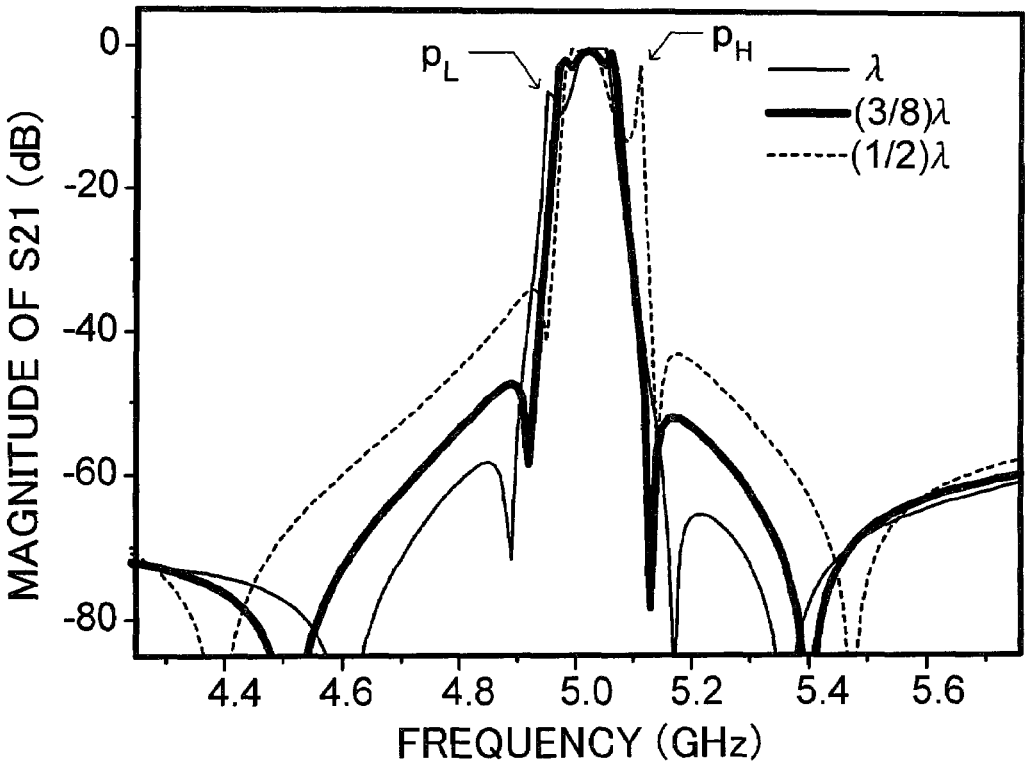
FIG. 9 is a graph showing simulation results of transmission characteristics of a plurality of samples obtained by changing an electrical line length of an intermediate waveguide between stages of the high frequency filter of the second embodiment.

FIG. 9 shows the transmission characteristics (frequency dependency of S21) when the transmission line length of the inter-stage waveguide 50 of the high frequency filter of the second embodiment is set equal to the transmission line wavelength corresponding to the fundamental resonance frequency, is set ⅜ times the transmission line wavelength, and is set to ½ times the transmission line wavelength. The abscissa represents a frequency in the unit of "GHz", and the ordinate represents a magnitude of S21 in the unit of "dB". A fine line, a bold line and a broken line in FIG. 9 indicate simulation results of parameter S21 when the electrical transmission line length of the inter-stage waveguide 50 is set equal to the transmission line wavelength corresponding to the fundamental resonance frequency, is set ⅜ times the transmission line wavelength, and is set to ½ times the transmission line wavelength, respectively.

When the electrical transmission line length of the inter-stage waveguide 50 is set equal to the transmission line wavelength, a resonance peak $p_L$ appears on the low frequency side of the passband. When the electrical transmission line length of the inter-stage waveguide 50 is set ½ times the transmission line wavelength, a resonance peak $p_H$ appears on the high frequency side of the passband. In contrast, when the electrical transmission line length of the inter-stage waveguide 50 is set ⅜ times the transmission line wavelength, good band pass filter characteristics are obtained.

As seen from the evaluation results, it is preferable that the electrical transmission line length of the inter-stage waveguide 50 is set ⅜ times the transmission line wavelength corresponding to the fundamental resonance frequency.

Although the high frequency filter of the second embodiment is constituted of two stages, a structure constituted of a plurality of three or more stages may be adopted. In this case, in order to make sharp the frequency cutoff characteristics, it is preferable that the conductive pattern at an odd number stage and the conductive pattern at an even number stage have mutually a mirror image relation.

In the first and second embodiments, although the plan shapes of the input and output ports are a crescent shape, other shapes may also be used so long as they provide electromagnetic coupling to the resonance pattern.

Figure 10:
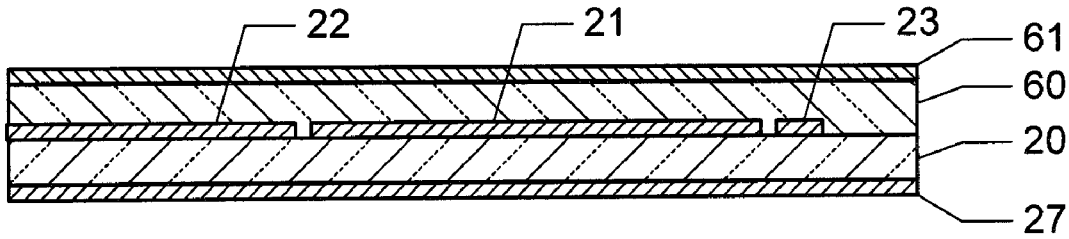
FIG. 10 is a cross sectional view showing the main portion of a high frequency filter according to a third embodiment.

FIG. 10 is a cross sectional view of the main portion of a high frequency filter according to the third embodiment. In the first and second embodiments, the high frequency filter is constituted of a microstrip line having the ground film 27 disposed only on one side of the conductive patterns. In the third embodiment, the high frequency filter is constituted of a strip line having ground films disposed on both sides of the conductive patterns.

The structure of a dielectric substrate 20, conductive patterns 21, 22 and 23 and the like on the principal surface of the substrate and a ground film 27 on the bottom surface is the same as that of the high frequency filter of the first embodiment. A dielectric film 60 is disposed on the principal surface of the dielectric substrate 20, covering the conductive patterns 21, 22 and 23 and the like. On the surface of the dielectric film 60, an upper ground film 61 is formed.

Even with this strip line structure, it is possible to obtain advantages as in the case of the high frequency filter of the microstrip line structure. The inner conductive patterns 21, 22 and 23 and the like may have a multiple stage structure like the high frequency filter of the second embodiment.

In the first to third embodiments, since the resonance pattern and the like are formed on one side of the substrate, a manufacture efficiency is high, and more distinctive advantages are expected particularly when the resonator is made of multiple stages. Further, since a circular resonance pattern is used, electric power tolerance is high, and nonlinearity upon input of large electric power can be suppressed.

Figure 11A:
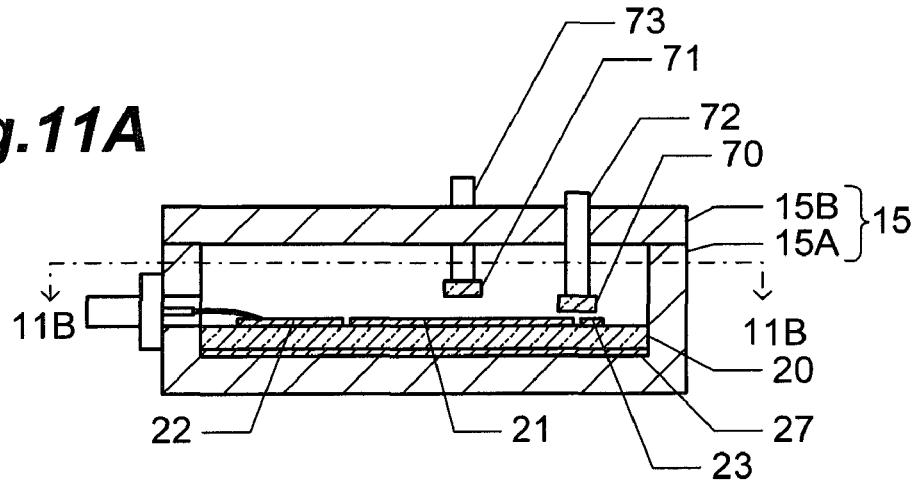
FIG. 11A is a cross sectional view of a high frequency filter according to a fourth embodiment.
Figure 11B:
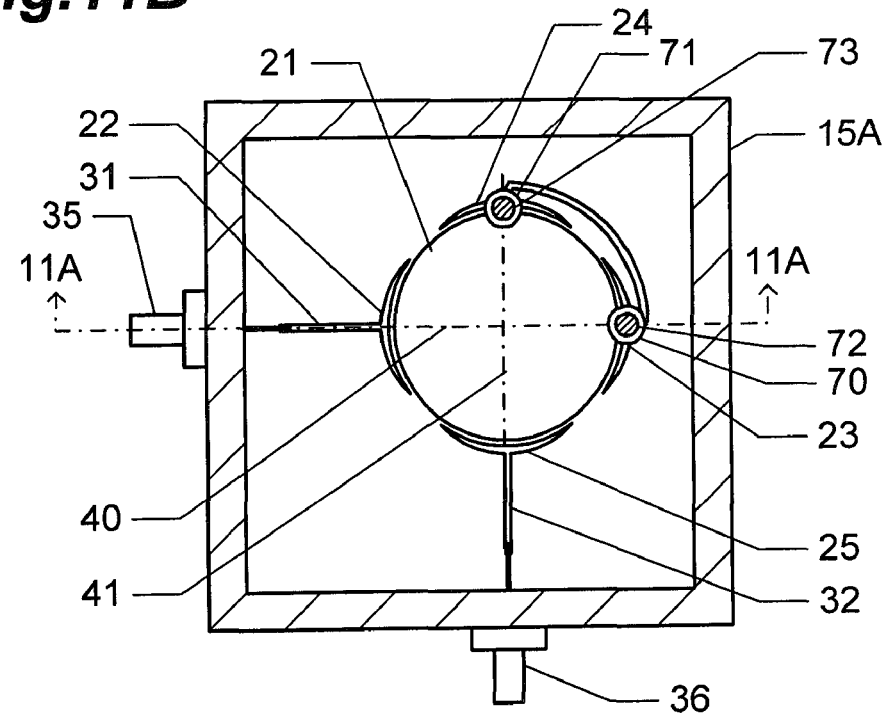
FIG. 11B is a cross sectional view of the high frequency filter of the fourth embodiment.

FIG. 11A is a cross sectional view of a high frequency filter according to the fourth embodiment. FIG. 11B is a plan cross sectional view taken along one-dot chain line 11B-11B shown in FIG. 11A. A cross sectional view taken along one-dot chain line 11A-11A shown in FIG. 11B corresponds to FIG. 11A. Description will now be made by paying attention to different points from the high frequency filter of the first embodiment shown in FIGS. 1A and 1B, and duplicate description of the components having the same structure is omitted.

A first dielectric member 70 and a second dielectric member 71 are disposed above a dielectric substrate 20 (FIG. 11A). The first dielectric member 70 is disposed near a coupling portion between a resonance pattern 21 and a first output port 23, and the second dielectric member 71 is disposed near a coupling portion between the resonance pattern 21 and a second input port 24 (FIG. 11B). The term "near" can be defined as a range where the influence of the electromagnetic fields generated at the coupling portions between the resonance pattern 21 and the input/output ports 23, 24 affects.

The first dielectric member 70 is supported via a first support member 72 to a package 15 (FIG. 11A). The first support member 72 can raise and lower the first dielectric member 70. Namely, a gap between the first dielectric member 70 and substrate 20 can be changed as illustrated in FIG. 11A. In a state that the first dielectric member 70 is lowered most, the first dielectric member 70 is in contact with the resonance pattern 21 and first output port 23.

As the first support member 72, for example, a screw threaded with a through hole formed through the wall of a ceiling plate 15B of the package 15 may be used. By rotating the screw, the first dielectric member 70 can be raised and lowered. As the first support member 72, a linear actuator may be used which makes an object translate in response to a drive signal from an external.

Similar to the first dielectric member 70, the second dielectric member 71 is supported via a second support member 73 to the package 15 to be able to rise and fall.

As the first dielectric member 70 and second dielectric member 71 are raised and lowered, an electrostatic capacitance between the resonance pattern 21 and first output port 23 and an electrostatic capacitance between the resonance pattern 21 and second input port 24 change. The transmission characteristics and reflection characteristics of the high frequency filter change correspondingly.

Figure 12:
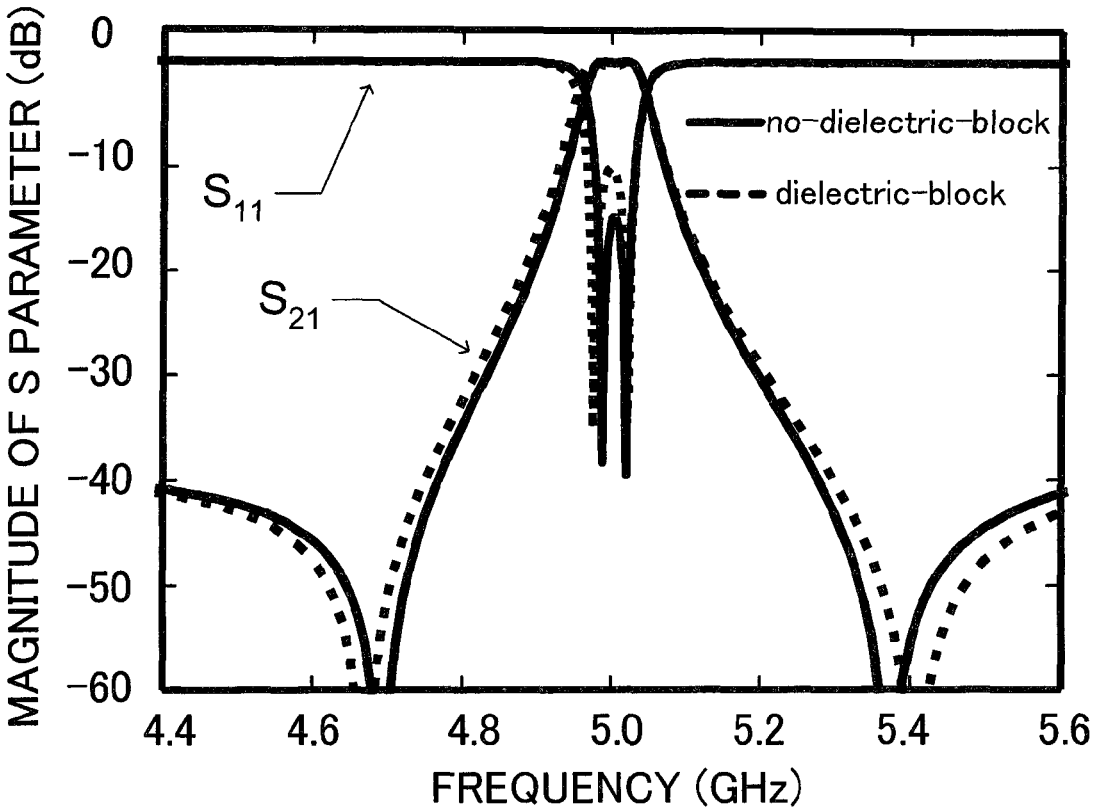
FIG. 12 is a graph showing simulation results of a frequency dependency of S parameters of a high frequency filter of the fourth embodiment.

FIG. 12 shows the frequency dependency of S parameters of the high frequency filter of the fourth embodiment. Solid lines of FIG. 12 indicate simulation results of S parameters when the first dielectric member 70 and second dielectric member 71 are not disposed, and broken lines indicate simulation results of S parameters in a state that the first dielectric member 70 is in contact with the resonance pattern 21 and first output port 23 and that the second dielectric member 71 is in contact with the resonance pattern 21 and second input port 24. Disc shaped MgO member having a diameter of 2 mm and a thickness of 0.5 mm was used as the first dielectric member 70 and second dielectric member 71.

It can be understood that the passband width becomes broad as the first dielectric member 70 and second dielectric member 71 are disposed. In this case, the center frequency hardly changes. As a gap is generated between the first dielectric member 70 and substrate 20 and between the second dielectric member 71 and substrate 20, the passband width has an intermediate width between when the dielectric members are disposed and when the dielectric members are not disposed, as shown in FIG. 12. By changing the gap, the transmission bandwidth can be changed.

In order to enhance controllability of the passband width, it is preferable to dispose the first dielectric member 70 and second dielectric member 71 in the region where an electromagnetic field is strong. For example, it is preferable to dispose the first dielectric member 70 so as to overlap with the gap between the resonance pattern 21 and first output port 23 as viewed in plane-view as illustrated in FIG. 11B. It is preferable to dispose the second dielectric member 71 so as to overlap with the gap between the resonance pattern 21 and second input port 24 as viewed in plane-view as illustrated in FIG. 11B.

It is preferable to use a structure that the first dielectric member 70 and second dielectric member 71 can be disposed in such a manner that a gap between the first dielectric member 70 and substrate 20 and a gap between the second dielectric member 71 and substrate 20 are equal to or narrower than 10 nm.

In the fourth embodiment, although the first dielectric member 70 and second dielectric member 71 have a disc shape, other geometrical shapes such as a cylinder shape, a cube shape and a rectangular parallelepiped shape may be used.

Also in the fourth embodiment, although MgO is used as the material of the first dielectric member 70 and second dielectric member 71, other dielectric materials may also be used. In order to enhance controllability and reduce a loss, it is preferable to use material having a high dielectric constant and a small dielectric loss. Such material is, for example, $SrTiO_3$, $TiO_2$, $Al_2O_3$ or the like other than MgO. The first dielectric member 70 and first support member 72 may be cast from one body made of dielectric material. Similarly, the second dielectric member 71 and second support member 73 may be casted from one body made of dielectric material.

If dielectric members are disposed near the coupling portion between the resonance pattern 21 and first input port 22 and near the coupling portion between the resonance pattern 21 and second output port 25, sharpness of the transmission characteristics changes, while the passband width hardly changes. Therefore, in order to control the passband width, it is preferable to dispose a dielectric member near at least one of coupling portions between the resonance pattern 21 and first output port 23 and between the resonance pattern 21 and second input port 24.

Although the present invention has been described in connection with the embodiments, the present invention is not limited thereto. For example, it is apparent to those skilled in the art that various modifications, improvements, combinations and the like are possible.

What is claimed is:

1. A high frequency filter comprising:

a substrate comprised of dielectric material;

a first resonance pattern comprised of conductive material, disposed over a principal surface of the substrate and having a circular plan shape, that is substantially solid;

a first input port electromagnetically coupled with the first resonance pattern at one cross point between a first virtual straight line passing through a center of the first resonance pattern and an outer circumference line of the first resonance pattern;

a first output port electromagnetically coupled with the first resonance pattern at the other cross point between the first virtual straight line and the outer circumference line of the first resonance pattern;

a second input port electromagnetically coupled with the first resonance pattern at one cross point between a second virtual straight line and the outer circumference line of the first resonance pattern, the second virtual straight line passing through the center of the first resonance pattern and crossing the first virtual straight line at a right angle;

a second output port electromagnetically coupled with the first resonance pattern at the other cross point between the second virtual straight line and the outer circumference line of the first resonance pattern;

a first inter-port waveguide for propagating a high frequency signal from the first output port to the second input port;

a second resonance pattern comprised of conductive material, disposed over the principal surface of the substrate and having a same plan shape as the first resonance pattern;

a third input port electromagnetically coupled with the second resonance pattern at one cross point between a third virtual straight line passing through a center of the second resonance pattern and an outer circumference line of the second resonance pattern;

a third output port electromagnetically coupled with the second resonance pattern at the other cross point between the third virtual straight line and the outer circumference line of the second resonance pattern;

a fourth input port electromagnetically coupled with the second resonance pattern at one cross point between a fourth virtual straight line and the outer circumference line of the second resonance pattern, the fourth virtual straight line passing through the center of the second resonance pattern and crossing the third virtual straight line at a right angle;

a fourth output port electromagnetically coupled with the second resonance pattern at the other cross point between the fourth virtual straight line and the outer circumference line of the second resonance pattern;

a second inter-port waveguide for propagating a high frequency signal from the third output port to the fourth input port; and an inter-stage waveguide for propagating a high frequency signal from the second output port to the third input port, wherein a transmission line length of the inter-stage waveguide is ⅜times a transmission line wavelength corresponding to a fundamental resonance frequency of the first resonance pattern.

2. A high frequency filter comprising:

a substrate comprised of dielectric material;

a first resonance pattern comprised of conductive material, disposed over a principal surface of the substrate and having a circular plan shape, that is substantially solid;

a first input port electromagnetically coupled with the first resonance pattern at one cross point between a first virtual straight line passing through a center of the first resonance pattern and an outer circumference line of the first resonance pattern;

a first output port electromagnetically coupled with the first resonance pattern at the other cross point between the first virtual straight line and the outer circumference line of the first resonance pattern;

a second input port electromagnetically coupled with the first resonance pattern at one cross point between a second virtual straight line and the outer circumference line of the first resonance pattern, the second virtual straight line passing through the center of the first resonance pattern and crossing the first virtual straight line at a right angle;

a second output port electromagnetically coupled with the first resonance pattern at the other cross point between the second virtual straight line and the outer circumference line of the first resonance pattern;

a first inter-port waveguide for propagating a high frequency signal from the first output Dort to the second input Dort;

a second resonance pattern comprised of conductive material, disposed over the principal surface of the substrate and having a same plan shape as the first resonance pattern;

a third input port electromagnetically coupled with the second resonance pattern at one cross point between a third virtual straight line passing through a center of the second resonance pattern and an outer circumference line of the second resonance pattern;

a third output port electromagnetically coupled with the second resonance pattern at the other cross point between the third virtual straight line and the outer circumference line of the second resonance pattern;

a fourth input port electromagnetically coupled with the second resonance pattern at one cross point between a fourth virtual straight line and the outer circumference line of the second resonance pattern, the fourth virtual straight line passing through the center of the second resonance pattern and crossing the third virtual straight line at a right angle;

a fourth output port electromagnetically coupled with the second resonance pattern at the other cross point between the fourth virtual straight line and the outer circumference line of the second resonance pattern;

a second inter-port waveguide for propagating a high frequency signal from the third output port to the fourth input port; and an inter-stage waveguide for propagating a high frequency signal from the second output port to the third input port, wherein as viewed toward the principal surface of the substrate, a direction of rotation from the first output port toward the second input port around the center of the first resonance pattern, is opposite to a direction of rotation from the third output port toward the fourth input port around the center of the second resonance pattern.

3. A high frequency filter comprising:

a substrate comprised of dielectric material;

a first resonance pattern comprised of conductive material, disposed over a principal surface of the substrate and having a circular plan shape, that is substantially solid;

a first input port electromagnetically coupled with the first resonance pattern at one cross point between a first virtual straight line passing through a center of the first resonance pattern and an outer circumference line of the first resonance pattern;

a first output port electromagnetically coupled with the first resonance pattern at the other cross point between the first virtual straight line and the outer circumference line of the first resonance pattern;

a second input port electromagnetically coupled with the first resonance pattern at one cross point between a second virtual straight line and the outer circumference line of the first resonance pattern, the second virtual straight line passing through the center of the first resonance pattern and crossing the first virtual straight line at a right angle;

a second output port electromagnetically coupled with the first resonance pattern at the other cross point between the second virtual straight line and the outer circumference line of the first resonance pattern; and a first inter-port waveguide for propagating a high frequency signal from the first output port to the second input port, wherein a transmission line length of the first inter-port waveguide is in a range between 90% and 110% of a transmission line wavelength corresponding to a fundamental resonance frequency of the first resonance pattern.

4. The high frequency filter according to claim 3, wherein the first input port, first output port, second input port, second output port and inter-port waveguide comprise conductive patterns comprised of conductive material and disposed over the principal surface of the substrate.

5. The high frequency filter according to claim 4, wherein the first input port, first output port, second input port, second output port and inter-port waveguide are comprised of superconductive material presenting superconductivity at a liquid nitrogen temperature.

6. The high frequency filter according to claim 3, further comprising a ground film disposed on a bottom surface of the substrate opposite to the principal surface.

7. The high frequency filter according to claim 3, wherein the circular plan shape is completely solid.

8. The high frequency filter according to claim 3, further comprising:

a dielectric member disposed in a region to be influenced by a generated electromagnetic field, at least at one of a coupling portion between the first resonance pattern and the first output port and a coupling portion between the first resonance pattern and the second input port; and a support member for supporting the dielectric member so as to be capable of changing a gap between the substrate and the dielectric member.

9. The high frequency filter according to claim 8, wherein the support member includes an actuator for rising and lowering the dielectric member relative to the substrate.

10. The high frequency filter according to claim 3, further comprising:

a package for accommodating and electrically shielding the substrate;

an input coaxial connector mounted on the package and connected to the first input port; and an output coaxial connector mounted on the package and connected to the second output port.

* * * * *